United States Patent [19]

Morita

[11] 4,083,549

[45] Apr. 11, 1978

[54] OPERATING TABLE FOR TRANSURETHRAL RESECTION

[76] Inventor: Masayoshi Morita, 62-940, Aza Kawadaira, Aramaki,Sendai-shi, Miyagi-ken, Japan

[21] Appl. No.: 793,764

[22] Filed: May 4, 1977

[30] Foreign Application Priority Data

Jun. 7, 1976 Japan ..... 51-73531[U]

[51] Int. Cl.[2] ..... A61G 13/00

[52] U.S. Cl. ..... 269/327

[58] Field of Search ..... 269/327, 13, 15; 108/24

[56] References Cited

U.S. PATENT DOCUMENTS

| | | | |
|---|---|---|---|
| 3,328,024 | 6/1967 | Weil | 269/327 |
| 3,386,444 | 6/1968 | Brenner et al. | 269/327 X |

*Primary Examiner*—Robert C. Watson

*Attorney, Agent, or Firm*—Armstrong, Nikaido, Marmelstein & Kubovcik

[57] ABSTRACT

An operating table provided with a vessel for receiving irrigating solution during transurethral resection. The chamber or vessel may be automatically moved lengthwise between a retracted or inoperative position under the operating table and an extended or receiving position where the chamber or vessel is extended forwardly of the operating table for receiving irrigating solution. That is, when an operator assumes an operating position the chamber or vessel may be automatically moved to the retracted position for permitting his operating freely, but when he assumes an irrigating discharging position the chamber or vessel can be automatically advanced in the extended position for receiving a discharged irrigating solution.

5 Claims, 3 Drawing Figures

OPERATING TABLE FOR TRANSURETHRAL RESECTION

BACKGROUND OF THE INVENTION

The present invention relates to an improvement of an operating table for transurethral resection which has been widely used recently all over the world and more particularly an operating table for transurethral resection provided with a solution receiving chamber or vessel which is responsive to the positions that an operator assumes during an operation to automatically move between a retracted position and an advanced position for receiving irrigating solution discharged.

In general, during transurethral resection of prostate, an endoscope is inserted into a urethra for observation of the operating area, and in order to obtain clear vision irrigating solution which is sterilized and stored in an irrigator is poured through a rubber hose and a surgical instrument. When a bladder is filled with irrigating solution, it must be discharged by pulling out the endoscope through an outer tube of the surgical instrument inserted into the urethra. Generally, an operator stands up and the discharged irrigating solution is received in a vessel disposed below an operating table. However during operation, an operator is between the thighs of a patient, being forced to assume an unnatural posture and sitting on an operating stool so that the solution receiving vessel must be retracted under the operating table. In one operation irrigating solution is discharged 50 to 70 times so that it is the very tedious for the operator to manually move the solution receiving vessel between the retracted and receiving positions so many times.

SUMMARY OF THE INVENTION

One of the objects of the present invention is therefore to provide an operating table for transurethral resection which may substantially eliminate the tedious and unnecessary burden on an operator manually moving an irrigating solution receiving vessel.

Another object of the present invention is to provide an operating table for transurethral resection which is provided with an irrigating solution receiving chamber or vessel which is responsive to the standing or sitting position of an operator for automatically moving to a position for receiving irrigating solution or to a retracted position under the operating table so that the operator may freely use his hands solely for the operation.

A further object of the present invention is to provide an operating table for transurethral resection which is provided with an irrigating solution receiving chamber or vessel which may be automatically moved between a retracted position under the operating table and an extended position for receiving irrigating solution when an operator depresses a foot pedal type change-over switch so that the operator may freely use his hands solely for the operation.

The above and other objects, features and advantages of the present invention will become more apparent from the following description of a preferred embodiment thereof taken in conjunction with the accompanying drawings.

DESCRIPTION OF THE PREFERRED EMBODIMENT

Figure 1:
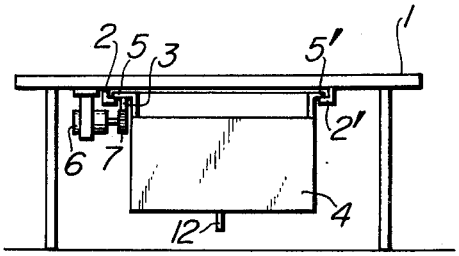
FIG. 1 is a front view of a preferred embodiment of the present invention.
Figure 2:
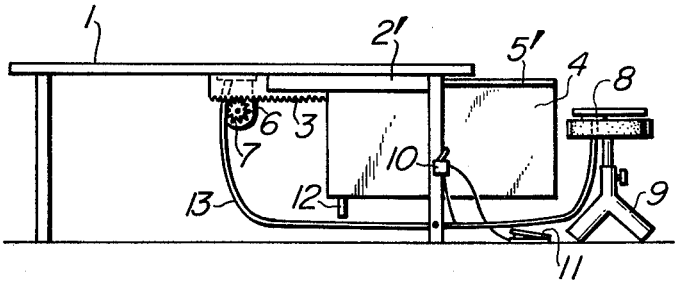
FIG. 2 is a side view thereof.

In FIGS. 1 and 2 there is shown an operating table in accordance with the present invention, comprising a table proper 1, a pair of parallel grooved guide rails 2 and 2' mounted on the undersurface of the table proper or flat board 1 and a solution receiving chamber or vessel 4 having its lengthwise upper flanges 5 and 5' slidably mounted on the rails 2 and 2' for movement lengthwise between a retracted position under the main body 1 for permitting the free performance of an operator sitting on a stool 9 and an extended position where as best shown in FIG. 2. The solution receiving chamber 4 is partly extended out of the main body 1 forwardly for receiving irrigating solution.

As best shown in FIG. 2 a rack 3 is attached at an outer side wall of the solution receiving chamber 4 adjacent to the upper side thereof, and an electric reversible motor 6 is supported by a bracket which in turn is mounted on the undersurface of the table proper 1 and has a pinion carried on the driving shaft and meshed with the rack 3. Therefore, upon rotation of the motor 6 in the counterclockwise direction, the pinion 7 drives the rack 3 and hence the solution receiving vessel 4 to the left in FIG. 2. Namely, to the retracted position, whereas upon rotation in the clockwise direction the solution receiving vessel 4 is caused to move to the right to the extended position.

In order to reverse the rotation of the motor 6 in the manner described above, a pressure-sensitive switch 8 is mounted on the top of the stool 9 and is electrically connected to the motor 6 through a cable 13. In this embodiment, when the operator sits down on the stool 9, the switch 8 is so actuated to cause the motor to rotate in the counterclockwise direction in FIG. 2 while when he stands up, the switch 8 is so actuated as to cause the motor 6 to rotate in the clockwise direction.

First and second stop switches such as limit switches (not shown) are mounted on the undersurface of the main body 1 in such a way that they may be actuated by the left end (in FIG. 2) of the rack 3. More particularly, the first switch is so positioned that it is actuated by the rack 3 when the solution receiving vessel 4 is advanced into the receiving position in FIG. 2, and consequently the rotation of the motor 6 in the clockwise direction may be stopped. In like manner the second stop switch is so positioned that it may be actuated when the solution receiving vessel 4 is retracted under the main body 1, and consequently the rotation in the counterclockwise direction of the motor 6 may be stopped. Furthermore the first and second stop switches are so operatively interconnected with the motor 6 that even when the first switch is kept opened the rotation in the counterclockwise direction of the motor 6 may be permitted even while the second stop switch is kept opened, the rotation in the clockwise direction of the motor 6 may be permitted.

When the operator sits down on the stool 9, the pressure-sensitive switch 8 is closed so that the motor 6 is rotated in the counterclockwise direction and consequently the solution receiving vessel 4 is retracted into the retracted position under the main body 1 in the manner described above. When irrigating solution is discharged, the operator is generally standing. Therefore, the switch 8 is so actuated as to cause the motor 6 to rotate in the clockwise direction. The solution receiving vessel 4 is advanced to the receiving position shown in FIG. 2 for receiving irrigating solution. In a transurethral resection operation, the operator must be in the standing position or sitting position, and as he sits down or stands up the solution receiving vessel 4 may be automatically retracted into the retracted position under the table proper or advanced into receiving position. As a result, it is not required to sterilized the solution receiving chamber 4 prior to an operation, and the manual operation of the receiving vessel 4 can be completely eliminated thus the operation itself can be greatly facilitated.

In addition, as shown in FIG. 2, a changeover switch 10 and a pedal switch 11 may be provided. With the change-over switch 10, the operator may suitably select either the pressure-sensitive switch 8 on the top of the stool 9 or the pedal switch 11 on the floor. Assume that the pedal switch 11 be selected, and then in response to the alternate depressions of the pedal switch 11 the solution receiving vessel 4 may be moved to the retracted position or receiving position and then to the receiving or retracted position.

Irrigating solution received in the vessel 4 may be discharged through a discharge hose 12 extended from the bottom thereof.

Figure 3:
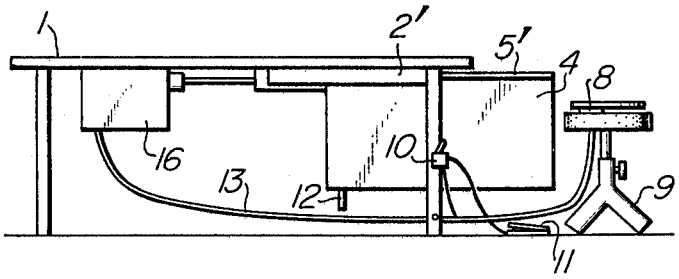
FIG. 3 is a side view of another preferred embodiment of the present invention.

So far the solution receiving vessel 4 has been described as being moved between the receiving and retracted position by a driving means consisting of the motor 6, the pinion 7 and the rack 3, but it will be understood that the present invention is not limited to this driving means only. For instance, as shown in FIG. 3, a combination of a hydraulic or pneumatic piston-cylinder assembly and a three-position, bidirectional solenoid operated valve 16 may be used, one of the three positions being a normal position.

In summary, according to the present invention the solution receiving vessel may be automatically advanced into the receiving position and retracted back into the retracted position so that a transurethral resection operation may be effectively and efficiently accomplished.

What is claimed is:

1. An operating table especially adapted for transurethral resection comprising;

(a) an operating table proper, (b) a pair of parallel grooved guide rails mounted lengthwise on the undersurface of said table proper, (c) a solution receiving vessel having its upper flanges slidably mounted on said grooved guide rails for movement between a retracted position under said table proper and an extended or receiving position where the vessel is extended forwardly of the front side of the table proper for receiving irrigating solution or the like, (d) reversible driving means for causing said reversible movement of said vessel between said retracted and receiving positions, and (e) actuating means responsive to the position of an operator for causing said reversible driving means to drive in either direction, whereby when the operator is in an operating position, said chamber or vessel may be automatically retracted in said retracted position under said main body.

2. An operating table as set forth in claim 1 wherein said driving means comprises;

(a) a rack mounted on said solution receiving vessel, (b) an electric reversible motor mounted on the undersurface of said table proper, and (c) a pinion carried by the driving shaft of said reversible motor and in mesh with said rack; and said actuating means comprises a change-over switch which is disposed on an operating stool or the like is electrically operatively connected to said reversible motor, and is so actuated when the operator stands up or sits down on said operating stool that said reversible motor is caused to rotate in one or the other direction to move said solution receiving vessel into the receiving or retracted position.

3. An operating table as set forth in claim 1 wherein said driving means comprises;

(a) a rack mounted on said solution receiving vessel, (b) an electric reversible motor mounted on the undersurface of said table proper, and (c) a pinion carried by the driving shaft of said reversible motor and in mesh with said rack; and said actuating means comprises a foot-pedal type change-over switch disposed at such a position that the operator may depress it as needs demand during an operation.

4. An operating table as set forth in claim 2 wherein said actuating means further comprises;

a foot-pedal type change-over switch electrically operatively connected to said reversible motor and disposed at such a position that the operator may depress it as needs demand during an operation, and a change-over switch electrically operatively connected to said change-over switch on said operating stool and said foot-pedal type change-over switch for selectively connecting either of two change-over switches to said reversible motor.

5. An operating table as set forth in claim 1 wherein said driving means comprises (a) a piston-cylinder assembly operatively coupled to said solution receiving chamber or vessel for said movement between the receiving and retracted positions, and (b) a two position, solenoid-operated directional control valve for controlling the direction of hydraulic or pneumatic pressure to be transmitted to said valve, thereby causing said piston-cylinder assembly to move in one or the other direction or holding it in the extended or retracted position so that said solution receiving vessel may be held in said receiving or retracted position.

* * * * *